US010727598B2

(12) United States Patent
Yu et al.

(10) Patent No.: US 10,727,598 B2
(45) Date of Patent: Jul. 28, 2020

(54) ANTENNA ARRAY SUITABLE FOR 5G MOBILE TERMINAL DEVICES

(71) Applicant: SPEED WIRELESS TECHNOLOGY INC., San Jose, CA (US)

(72) Inventors: Bin Yu, Suzhou (CN); Zhanyi Qian, Suzhou (CN); Xitong Wu, Suzhou (CN)

(73) Assignee: SPEEDLINK TECHNOLOGY INC., Cupertino, CA (US)

( * ) Notice: Subject to any disclaimer, the term of this patent is extended or adjusted under 35 U.S.C. 154(b) by 46 days.

(21) Appl. No.: 15/725,167

(22) Filed: Oct. 4, 2017

(65) Prior Publication Data

US 2018/0309186 A1 Oct. 25, 2018

(30) Foreign Application Priority Data

Apr. 20, 2017 (CN) ..... 2017 1 0262532

(51) Int. Cl.

| | |
|---|---|
| ***H01Q 1/24*** | (2006.01) |
| ***H01Q 21/22*** | (2006.01) |
| ***H01Q 21/29*** | (2006.01) |
| ***H01Q 9/16*** | (2006.01) |
| ***H01Q 1/38*** | (2006.01) |

(52) U.S. Cl.

CPC ..... *H01Q 9/16* (2013.01); *H01Q 1/241* (2013.01); *H01Q 1/243* (2013.01); *H01Q 1/38* (2013.01); *H01Q 21/22* (2013.01); *H01Q 21/29* (2013.01)

(58) Field of Classification Search

CPC ..... H01Q 1/2283; H01Q 1/241; H01Q 1/242; H01Q 1/243; H01Q 1/246; H01Q 3/24; H01Q 3/26; H01Q 3/2617; H01Q 3/30; H01Q 3/34; H01Q 3/36; H01Q 3/38; H01Q 9/16; H01Q 9/285; H01Q 13/085; H01Q 21/062; H01Q 21/064; H01Q 21/065; H01Q 21/22; H01Q 21/28; H01Q 21/29; H01Q 21/293; H01Q 25/002

See application file for complete search history.

(56) References Cited

U.S. PATENT DOCUMENTS 6,538,603 B1 * 3/2003 Chen ..... H01P 1/181 342/372

7,075,485 B2 * 7/2006 Song ..... H01Q 1/246 343/700 MS (Continued)

*Primary Examiner* — Daniel Munoz

*Assistant Examiner* — Patrick R Holecek

(74) *Attorney, Agent, or Firm* — Womble Bond Dickinson (US) LLP

(57) ABSTRACT

A new antenna array of the invention which has simple structure, small volume and can adopt a variety of realization forms, it can be easily integrated in the PCB of the mobile terminal using surface mount technology (SMT) or multi-layer PCB integration and other forms of technology. The antenna array is compact and can be configured with different number of antenna elements to meet the gain requirements. The antenna array is small in size and has a wide antenna bandwidth that can cover multiple 5G millimeter-wave bands while maintaining a directional high antenna gain and a stable radiation pattern. The antenna array can satisfy the millimeter-wave 5G communication requirements such as high gain, beam forming characteristics, beam scanning characteristics, and can be easily integrated into a portable mobile terminal.

9 Claims, 20 Drawing Sheets

(56) References Cited

U.S. PATENT DOCUMENTS

| | | | | |
|---|---|---|---|---|
| 9,570,809 | B2 * | 2/2017 | Ganchrow | H01Q 9/285 |
| 9,768,501 | B2 * | 9/2017 | Maltsev | H01Q 3/36 |
| 10,135,149 | B2 * | 11/2018 | Zhou | H01Q 13/106 |
| 2018/0123245 | A1 * | 5/2018 | Papio Toda | H01Q 21/0075 |

* cited by examiner

ANTENNA ARRAY SUITABLE FOR 5G MOBILE TERMINAL DEVICES

RELATED APPLICATIONS

This application claims the priority of Chinese patent application No. 201710262532.6, filed Apr. 20, 2017, which is incorporated by reference in its entirety.

FIELD OF THE DISCLOSURE

This disclosure relates generally to the technical field of antenna. More specifically, this disclosure relates to an antenna array device using in a 5G mobile terminal.

BACKGROUND

Nowadays, the new customer requirements and business pattern have changed a lot. Traditional services like voice, short message have been replaced by mobile internet. Progress on cloud computing puts the core of the service into the cloud and the transmission of controlling message is mainly between terminals and internet, therefore this kind of business mode places huge challenge to the traditional voice communication model. M2M/IoT brings mass devices connection, ultralow latency services, ultrahigh definition, and virtual reality services and enhanced reality services bring the transmission speed requirements of far beyond Gigabit per second (Gbps), but the existing 4G technology cannot satisfy such requirements.

Facing to human's information society in the future of 2020, related technology of 5G has not reached a stable standard, but the basic features of 5G are clear, such as high speed, low latency, mass devices connection, low power consumption. 5G terminal antenna is the main component of 5G terminals. Unless we innovatively defeat the technology difficulty of antenna design can we ensure a normal run and commercial use of 5G system. So this invention plays a positive and vital role in boosting and promoting the development of the new generation of mobile communication system and 5G terminals.

The existing millimeter wave antenna elements that can be integrated in the mobile terminals include monopole, dipole, Yagi, slot, patch, Vivaldi antennas. Particularly, Yagi, patch, Vivaldi antennas are directional antennas with narrow beam width and high gain. Slot and dipole antenna are omnidirectional in free space, but when they are integrated on the PCB board, the antenna radiation pattern may become directional due to the influence of dielectric substrate and ground board. Some low efficient and omnidirectional radiating antennas such as IFA, PIFA or other electrically small antenna for 3G/4G mobile terminals does not meet the requirements of the 5G communication. Magneto-electric dipole has the characteristics of broadband, high gain and directional pattern, which is suitable to form a 5G antenna array and can be integrated in a portable mobile terminal.

SUMMARY

This disclosure provides an antenna array apparatus for a 5G mobile terminal. The antenna array apparatus comprises magneto-electric dipole antenna arrays and radio frequency frontend modules. The antenna array is composed of multiple magneto-electric dipole antenna elements, which are connected to the radio frequency frontend modules respectively.

The magneto-electric dipole antenna element comprises an electric dipole and a magnetic dipole, and the electric dipole and the magnetic dipole are perpendicularly intersected, and the midpoint of the intersection is the feed point. The electric dipole can be a metal block, wrapped copper or metal vias along the thickness direction of the PCB. The magnetic dipole comprises a pair of copper layers on the upper and lower side of the PCB board and a group of metal vias. The multilayer PCB board is formed by laminating different layers of dielectric substrate. The antenna elements are of the same or similar structure, the spacing between the elements is determined according to the antenna array pattern or the antenna array scanning angle. Preferably, the spacing is from half-wavelength to one wavelength.

Each of the magneto-electric dipole antenna elements is excited by a multi-band or a wide band RF (radio frequency) frontend module, and the RF frontend module is connected to the feeder line of the antenna element.

The RF frontend module comprises a switch, a receiving module, a transmitting module and a local oscillation signal generating module for generating four quadrature local oscillation signals supplied to the transmitting module and the receiving module. The receiving module and the transmitting module are respectively connected with the switch, and the switch is connected with the antenna array.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

The present invention will now be described in further detail with reference to the accompanying drawings and embodiments so that the advantages and features of the invention will be more readily understood by those skilled in the art. It is to be understood that these embodiments are merely illustrative of the concepts of the invention rather than limiting the scope of the invention. In addition, various changes and modifications may be made by those skilled in the art upon reading the instruction of the present invention, which also fall within the scope of the claims.

Embodiment 1

Figure 1:
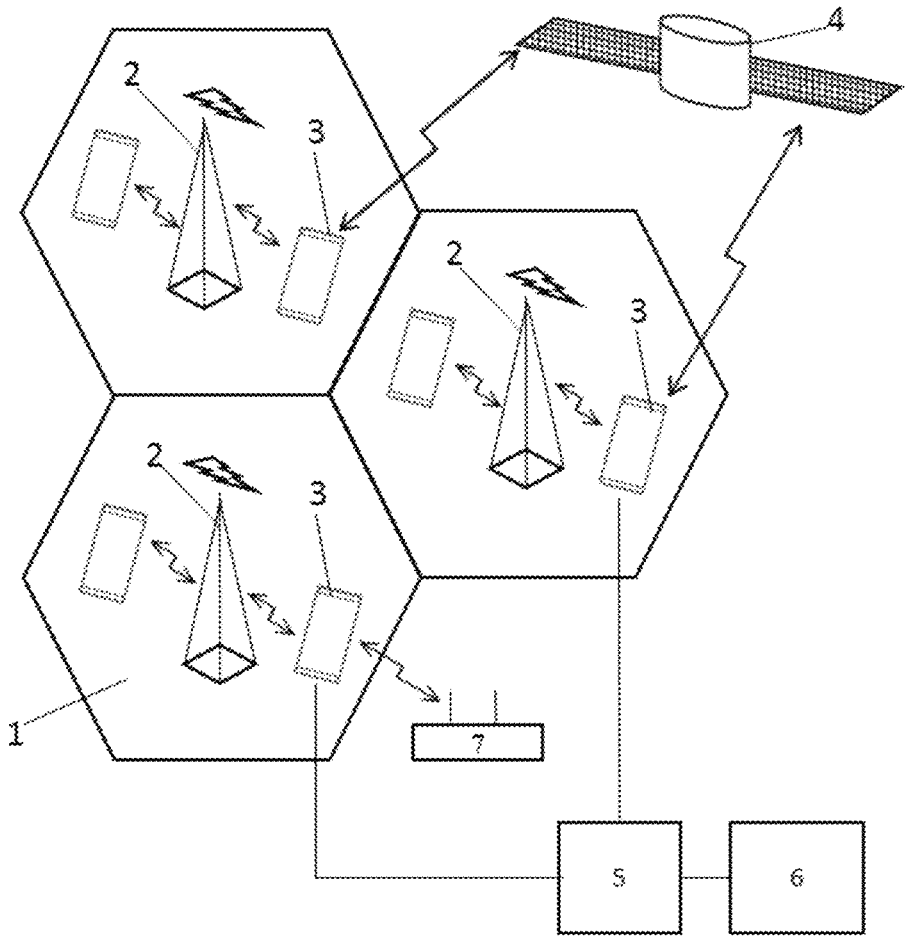
FIG. 1 is a block diagram of the present invention applied to a mobile communication network.

FIG. 1 is an application of the present invention to a wireless communication network, which may include multiple cells 1, and cell 1 includes a base station 2 and a mobile terminal 3. The network can use a variety of communication protocols or standards for voice communications and data communications. The mobile terminal 3 may communicate within the mobile network and may also communicate with the satellite navigation system 4 (such as GPS, Beidou, GLONASS, etc.), and the mobile terminal 3 may communicate with the mobile telephone switching center 5 or the Public Switched Telephone Network (PSTN) 6, or may communicate with other mobile terminals through the mobile switching center 5 or the public switched telephone network 6, and may also perform data exchange with the router 7, and the base station 2 may also communicate with the mobile terminal 3 through a specific channel.

Figure 2:
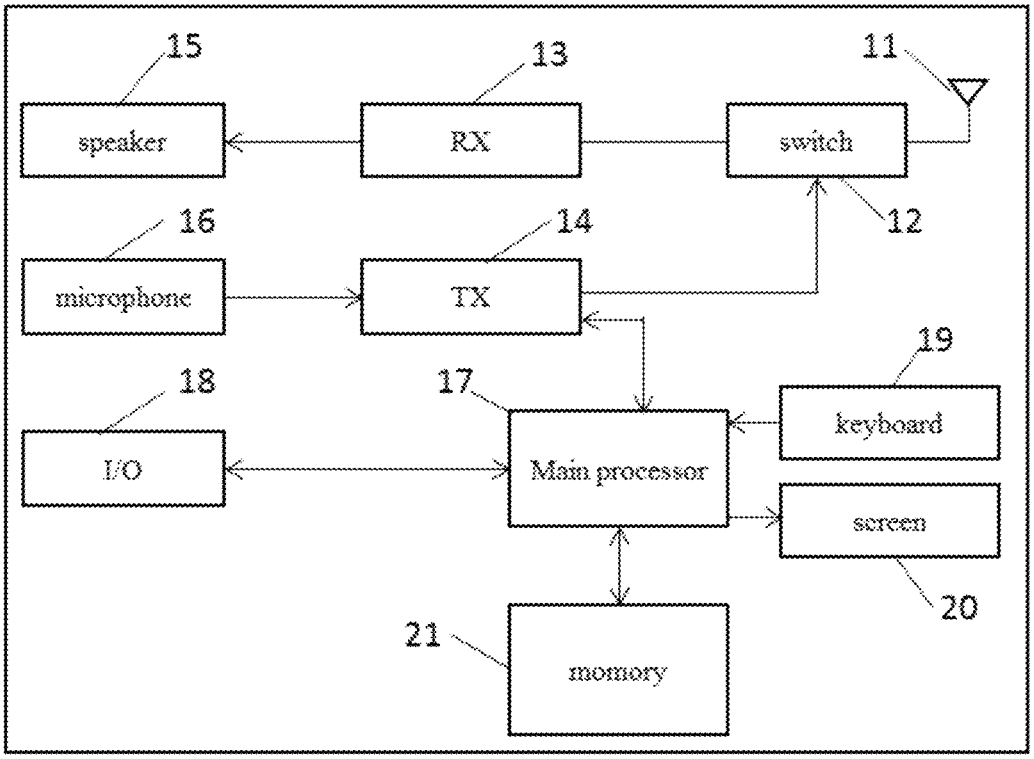
FIG. 2 is a block diagram of a mobile terminal to which an embodiment of the present invention is applied.

FIG. 2 is a block diagram of the mobile terminal 3, which includes an antenna array 11, a radio frequency (RF) frontend module 1110, a speaker 15, a microphone 16, a main processor 17, an input/output (TO) interface 18, a keyboard 19, a display screen 20, and a memory 21. The RF frontend module 1110 generates a post-processed intermediate frequency signal/baseband signal by filtering and decoding the RF signal transmitted by the base station 2 and received by the antenna array 11. This signal can be transmitted to the speaker 15 or to the main processor 17 for further process. The RF frontend module 1110 encodes or digitally processes the voice data received by the microphone 16 and the baseband data received by the main processor 17, then up-converts the post-processed baseband signal to RF signal, which will be radiated through the antenna array 11.

Figure 3:
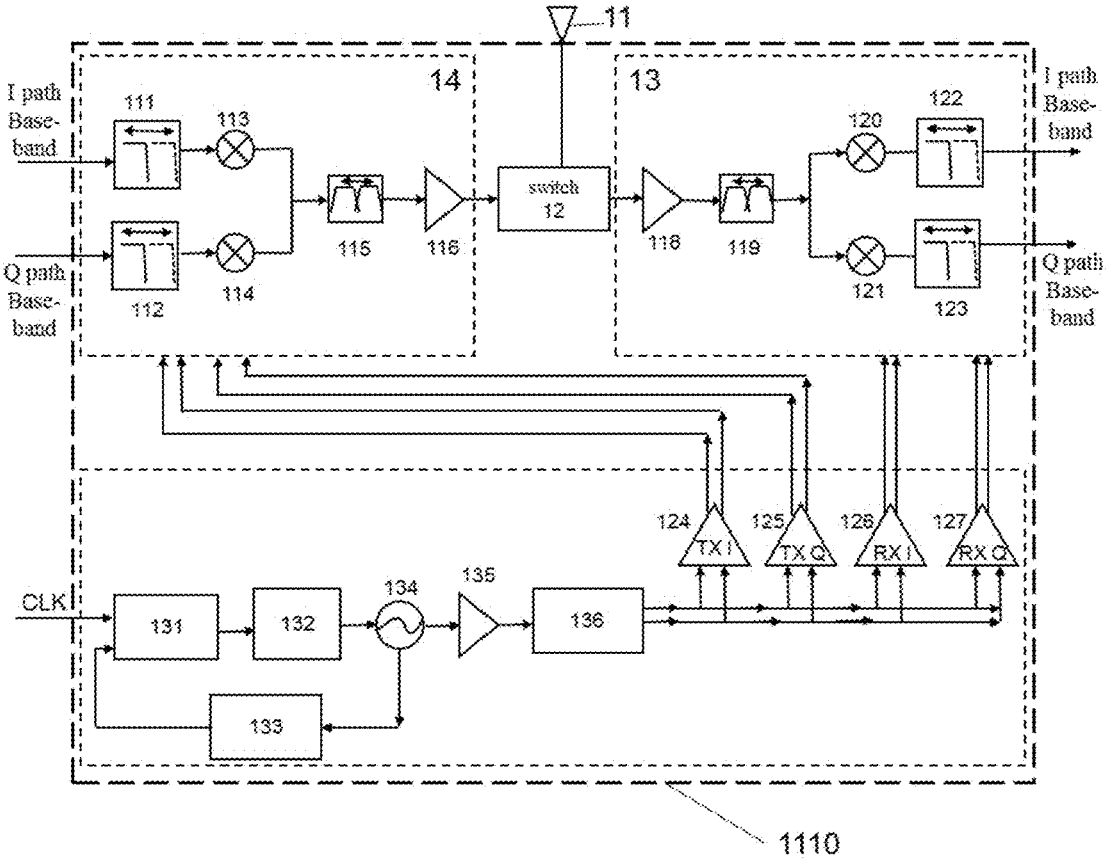
FIG. 3 is a block diagram of the RF frontend module according to one embodiment of the present invention.

FIG. 3 is a block diagram of a radio frequency frontend module of the present invention, which comprises a switch 12, a receiving module 13, a transmitting module 14, and a local oscillation signal generation module 150. The receiving module 13 includes a broadband low noise amplifier 118, a first tunable band-pass filter 119, an I-path down-conversion mixer 120, a Q-path down-conversion mixer 121, a first tunable low-pass filter 122 and a second tunable low-pass filter 123. The input of the broadband low noise amplifier 118 is connected to the switch 12 and the output of the broadband low noise amplifier 118 is connected to the input of the first tunable band-pass filter 119, and the output port of the first tunable band-pass filter 119 is connected to the input of the I-path down-conversion mixer 120 and the input of the Q-path down-conversion mixer 121 respectively.

The output of the I-path down-conversion mixer 120 is connected to the input port of the first tunable low-pass filter 122. The output port of the Q-path down-conversion mixer 121 is connected to the input port of the second tunable low-pass filter 123. The local oscillation signal RXI 126 is mixed with the signal transmitted to the I-path down-conversion mixer 120 to obtain a down-conversion signal, and the local oscillation signal RXQ 127 is mixed with the signal transmitted to the Q-path down-conversion mixer 121 to obtain a down-conversion signal, and the I-path down-conversion signal is transmitted to the first low-pass filter 122, then an I-path baseband signal is obtained, and the Q-path down-conversion signal is transmitted to the first low-pass filter 123, then a Q-path baseband signal is obtained.

The transmitting module 14 includes a broadband amplifier 116, a second tunable band-pass filter 115, an I-path up-conversion mixer 113, a Q-path up-conversion mixer 114, a third tunable low-pass filter 111, and a fourth tunable low-pass filter 112. The output port of the broadband amplifier 116 is connected to the switch 12 and the input port of the broadband amplifier 116 is connected to the output port of the second tunable band-pass filter 115, and the input port of the second tunable band-pass filter 115 is connected with the output ports of 113 and 114, and the input port of the I-path up-conversion mixer 113 is connected with the output port of the third tunable low-pass filter 111, the input port of the Q-path up-conversion mixer 114 is connected with the output port of the forth tunable low-pass filter 112.

The local oscillation signal TXI 124 is mixed with the I-path baseband signal in the up-conversion mixer 113 to obtain an up-conversion signal, the local oscillation signal TXQ 125 is mixed with the Q-path baseband signal in up-conversion mixer 114 to obtain an up-conversion signal, and the up-conversion signal is transmitted to the second tunable band-pass filter 115 to obtain a desired signal, and the signal is amplified by the broadband power amplifier 116, then is transmitted to the switch 12, and the switch selects the transmission link to radiate the signal through the antenna array 11. The local oscillation signal generation module 150 includes a phase detector 131, a loop filter 132, a programmable divider 133, a local oscillation buffer 135, and an I/Q quadrature signal generator 136, wherein the phase detector 131, the loop filter 132, the programmable divider 133 compose a phase-locked loop.

The principle of the RF frontend module of the present invention is as follows. The reference clock signal is transmitted to the phase-locked loop (PLL), which is consists of the phase detector 131, the loop filter 132, and the programmable divider 133. The local oscillation signal 134 can be generated by the PLL, then transmitted to the I/Q quadrature signal generator 136, which generates the four path quadrature LO signals transmitted to the transmitting module 14 and receiving module 13. In the transmitting module 14, the I-path signal is filtered by the third low-pass filter 111, and is mixed with the local oscillation signal TXI 124 to generate an up-conversion signal in the I-path mixer 113. The Q-path signal is filtered by the forth low-pass filter 112, and is mixed with the local oscillation signal TXQ 125 to generate an up-conversion signal in the Q-path mixer 114.

Through the second tunable band-pass filter 115, the RF signal is transmitted to the switch 12 via the broadband power amplifier 116. The switch 12 selects the transmission link to radiate the signal through the antenna 11. In the receiving module 13, the switch 12 switches to the receive link, and the signal received by the antenna 11 is transmitted to the broadband low noise amplifier 118, and through the first tunable band-pass filter 119, the signal is mixed with the local oscillation signal RXI 126 in the I-path down-conversion mixer 120 to generate an I-path down-conversion signal. While in the Q-path link, the signal that passes through the first tunable band-pass filter 119 is mixed with the local oscillation signal RXQ 127 in the Q-path down-conversion mixer 121 to generate a Q-path down-conversion signal. The I-path down-conversion signal is transmitted to the first tunable low pass filter 122, then the I-path baseband signal is obtained, and the Q-path down-conversion signal is transmitted to the second tunable low pass filter 123, then the Q-path baseband signal is obtained. The RF frontend module of the invention has the advantages that the filter is a tunable frequency device and the amplifier is a broadband device. Thus the module can work in a wide frequency band and cover multiple 5G millimeter wave bands. The switch 12 is a single-pole double-throw switch (SPDT) or a double-pole double-throw switch (DPDT), and the SPDT switch switches between the receiving module 13 and the transmitting module 14.

Figure 4:
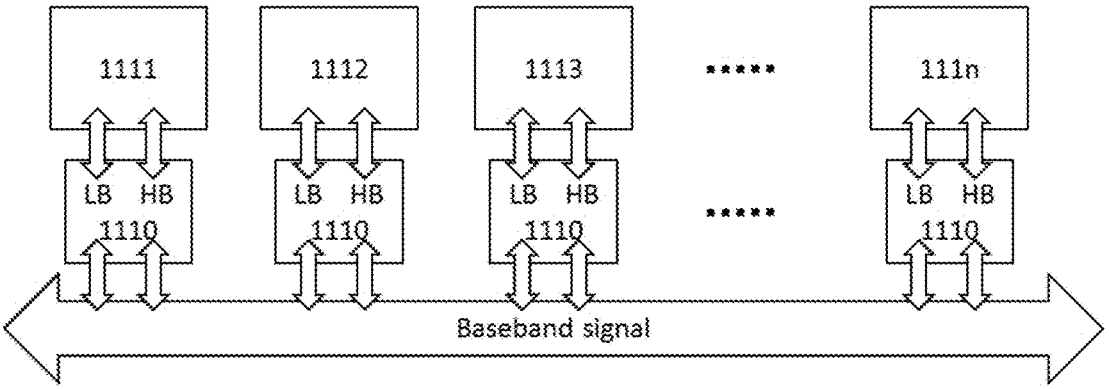
FIG. 4 is a frame diagram of the RF frontend module and the N-element antenna array according to one embodiment of the present invention.

FIG. 4 is the frame diagram in which antenna array is combined with RF frontend modules according to the present invention. N elements in the antenna array can be represented by element 1111, element 1112, element 1113 . . . element 111*n* respectively. N is an integer greater than 1, and the antenna elements 1111, 1112, 1113, . . . 111*n* can be the same structure or similar structure, and each antenna element is connected to a RF frontend module 1110. Generally, if the spacing between each antenna element is small, the radiation pattern of the antenna array may be affected, and if the spacing between each antenna element is large, the scanning angle of the antenna array may be limited. Preferably, the antenna element spacing is between half-wavelength and one wavelength, which is determined by requirements of beam pointing or beam scanning angle, and each antenna element is connected to the port of the baseband signal through the RF frontend module 1110.

Figure 5:
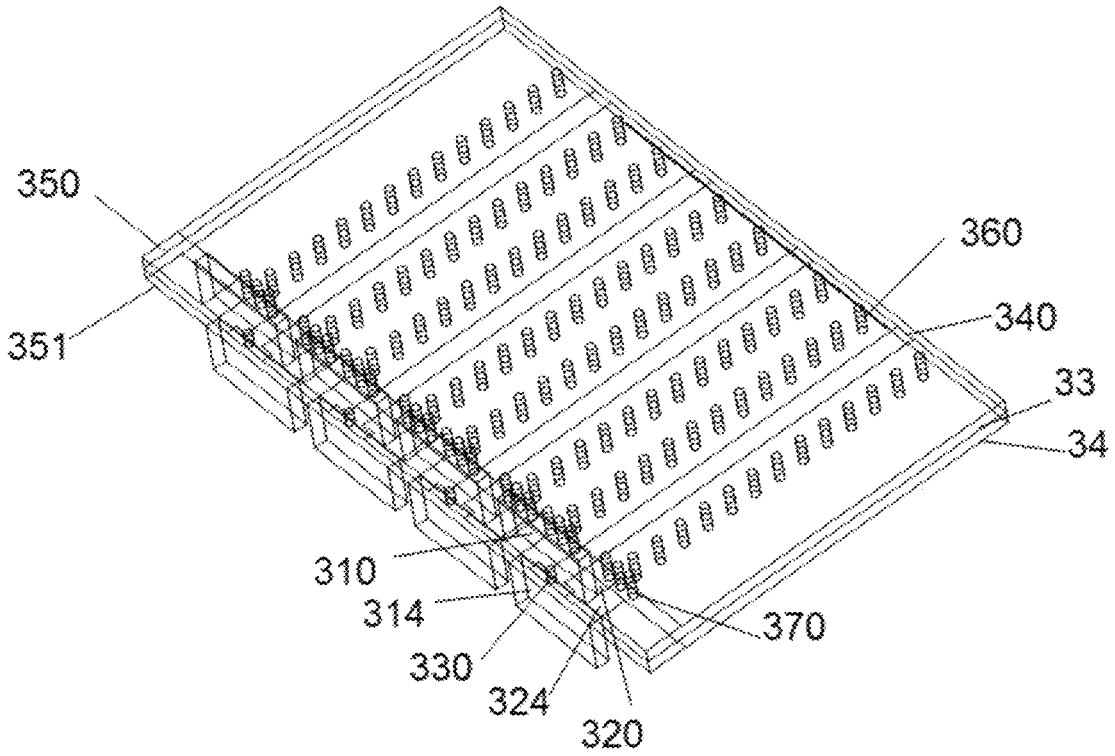
FIG. 5 is a stereogram of a four element antenna array according to one embodiment of the present invention.
Figure 6:
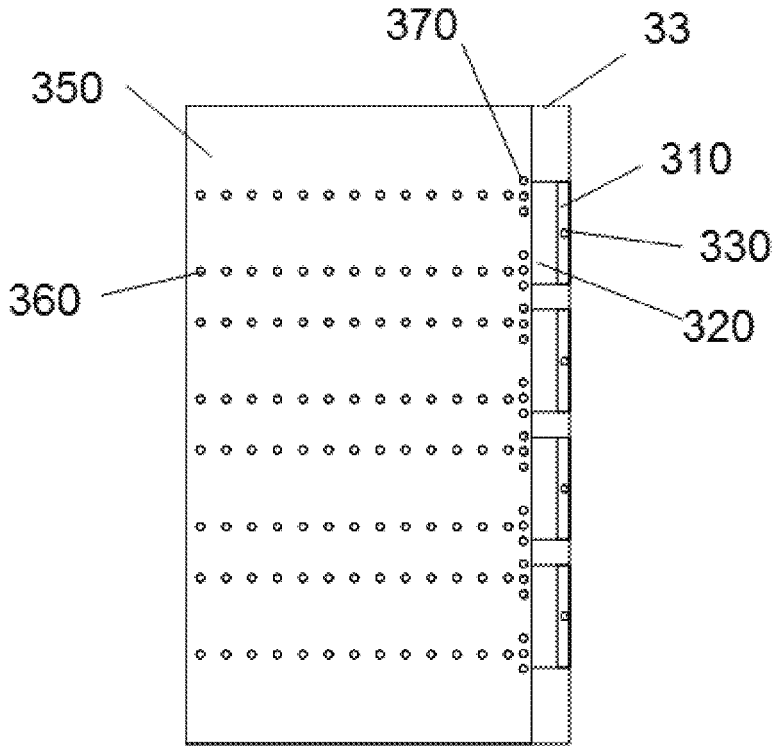
FIG. 6 is a plan view of the first printed copper layer of a four-element antenna array according to one embodiment of the present invention.
Figure 7:
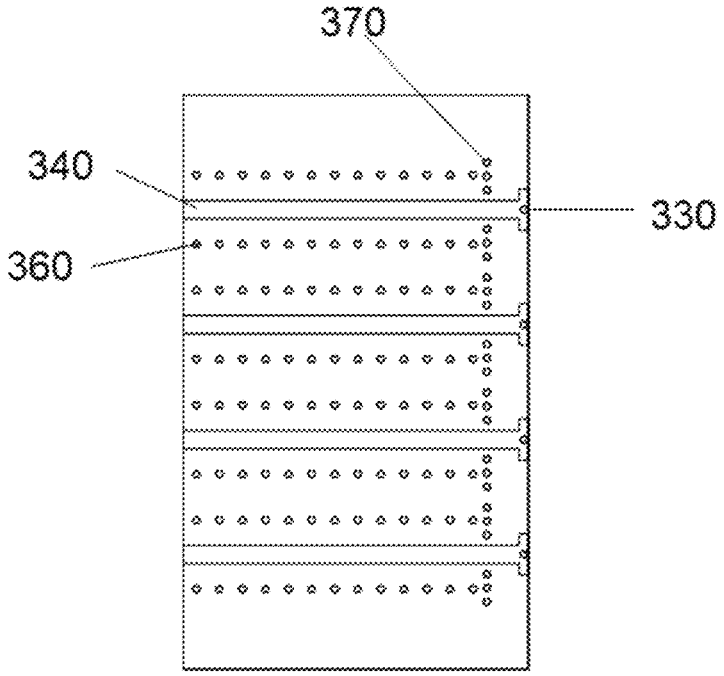
FIG. 7 is a plan view of the second printed copper layer of a four-element antenna array according to one embodiment of the present invention.
Figure 8:
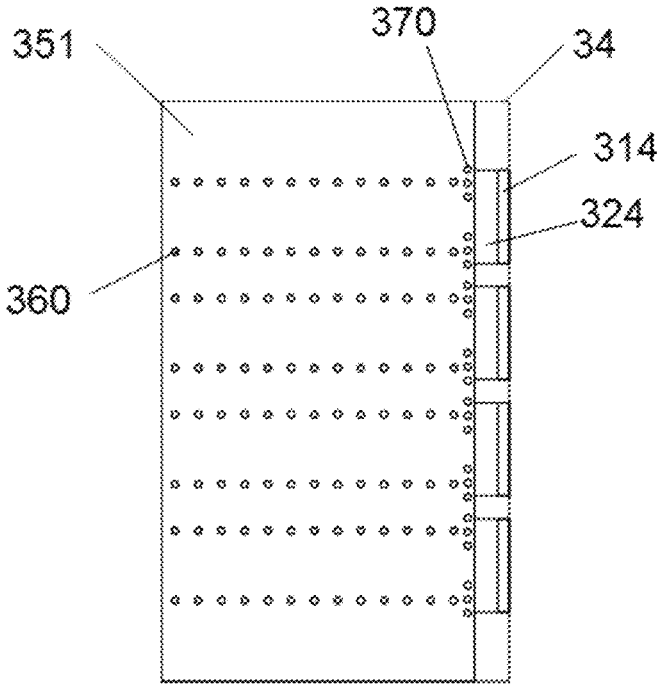
FIG. 8 is a plan view of the third printed copper layer of a four-element antenna array according to one embodiment of the present invention.

FIG. 5-FIG. 8 show an antenna array diagram of the embodiment of the present invention. FIG. 5 is the stereogram of the structure of the four-element antenna array of the present invention. The first printed copper layer shown in FIG. 6 is the upper surface of the dielectric substrate 33. As shown in FIG. 7, the second printed copper layer is between the dielectric substrate 33 and 34, the third printed copper layer 8 is the lower surface of the substrate 34 as shown in FIG. 8.

The size or structure of the four antenna elements can be the same or similar, and the four antenna elements are arranged in order. The spacing between the adjacent elements is the same or different. Generally, if the spacing between each antenna element is small, the radiation pattern of the antenna array may be affected, and if the spacing between each antenna element is large, the scanning angle of the antenna array may be limited. Preferably, the antenna element spacing is between half-wavelength and one wavelength, which is determined by the requirements of the beam pointing or the beam scanning angle. Each element of the array can be excited by a radio frequency frontend module 1110 that operates at multiple frequency bands. The main advantages of the four-element antenna array of the present invention are that the antenna structure is compact and the occupied clearance area is small. The bandwidth of antenna is wide, and it can cover multiple frequency 5G bands while maintaining a stable end-fire radiation pattern.

The antenna element of the array is a magneto-electric dipole antenna, and the antenna element includes a first rectangular metal block 310, a second rectangular metal block 314, a first rectangular copper layer 320, a second rectangular copper layer 324, a first PCB dielectric substrate 33, a second dielectric substrate 34, a first copper layer 350, a second copper layer 351, a metal vias 330, a first group of metal vias 360, a second group of metal vias 370, a metal strip 340. The first PCB dielectric substrate 33 is laminated with the second PCB dielectric substrate 34, and the first rectangular copper layer 320 is printed on the upside of the first PCB dielectric substrate layer 33, which is near the edge of the substrate. The second rectangular copper layer 324 is printed on the underside of the second PCB dielectric substrate layer 34, which is also near the edge of the substrate and has an opposite position to the copper layer 320.

The first rectangular metal block 310 is connected to the first rectangular copper layer 320 through SMT (surface mount technology), and the second rectangular metal block 314 is connected to the second rectangular copper layer 324 through SMT. The first copper layer 350 is printed on upside of the first PCB dielectric substrate 33, and the second copper layer 351 is printed on the underside of the second PCB dielectric substrate 34. The metal strip 340 is between the first PCB dielectric substrate 33 and the second PCB dielectric substrate 34. The metal vias 330 passes through the first PCB dielectric substrate 33 and connects the first rectangular copper layer 320. The spacing between the metal vias 330 and the edge of the PCB dielectric substrate 33 is within 1 mm. The first copper layer 350 and the second copper layer 351 are connected by a first group of metal vias 360 and a second group of metal vias 370, and the first group of metal vias 360 and the second group of metal vias 370 consist of N (N≥2) metal vias, and the spacing between adjacent metal vias is less than quarter-wavelength. Preferably, the diameter of the metal vias is less than one eighth of the wavelength. The metal strip 340 is located between the first PCB dielectric substrate 33 and the second PCB dielectric substrate 34, and the end of the metal strip 340 is connected to the first rectangular copper layer 320 through the metal vias 330 and then it can realize the feeding of the antenna element.

The size of the first rectangular copper layer 320 and the second rectangular copper layer 324 can be the same or different, and the size of the magnetic dipole is related to the permittivity of the substrate, preferably, and the size of the magnetic dipole is quarter-wavelength along the current direction. The size of the first rectangular metal block 310 and the second rectangular metal block 314 can be the same or different. The size of the electric dipole and magnetic dipole in the antenna array can be optimized by requirements of the operating frequency and the radiation pattern.

Embodiment 2

Figure 9:
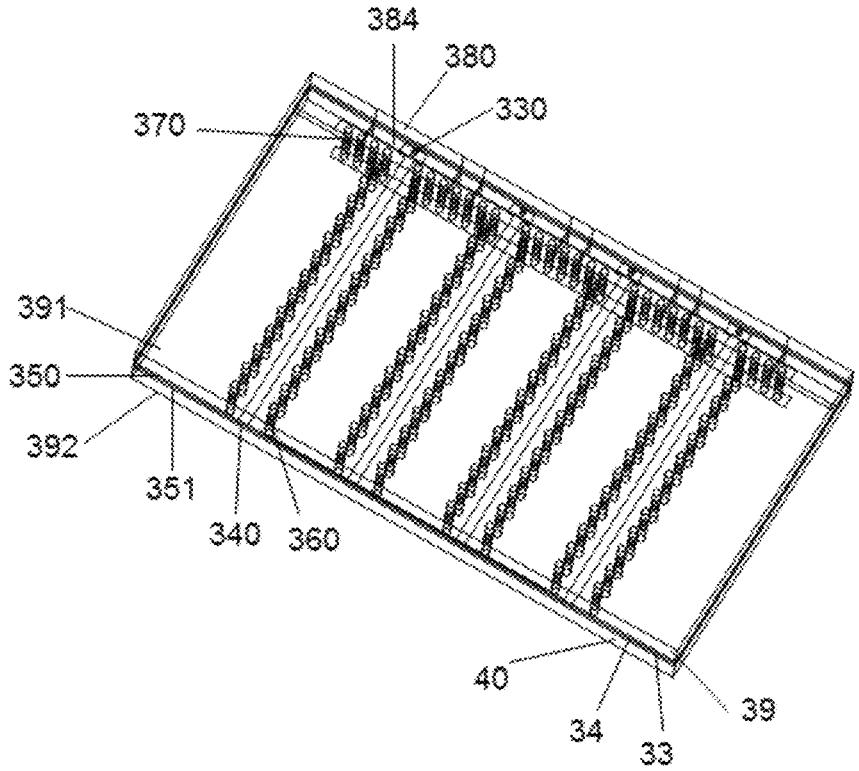
FIG. 9 is a stereogram of a four-element antenna array according to another embodiment of the present invention.
Figure 10:
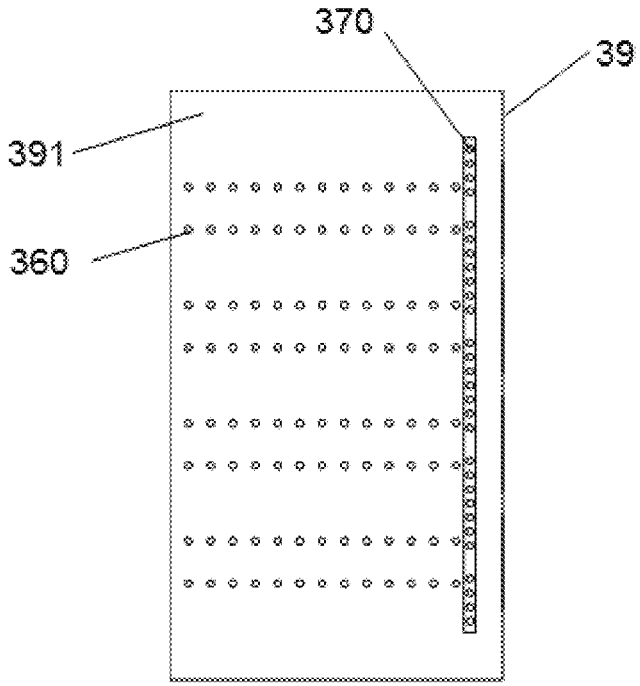
FIG. 10 is a plan view of the first printed copper layer of a four-element antenna array according to another embodiment of the present invention.
Figure 11:
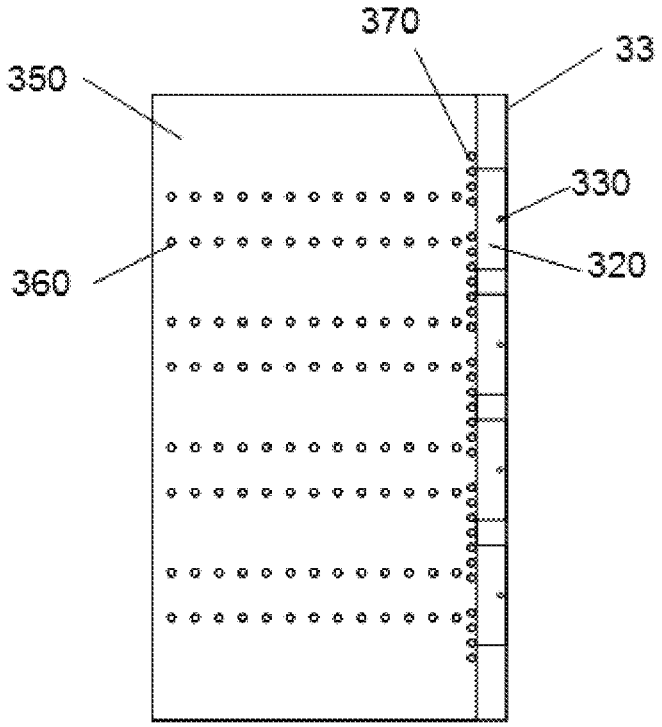
FIG. 11 is a plan view of the second printed copper layer of a four-element antenna array according to another embodiment of the present invention.
Figure 12:
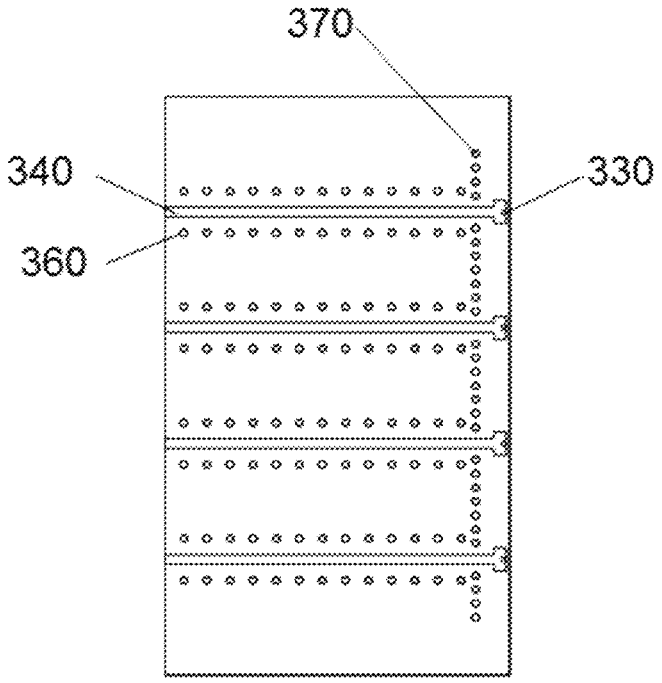
FIG. 12 is a plan view of the third printed copper layer of a four-element antenna array according to another embodiment of the present invention.
Figure 13:
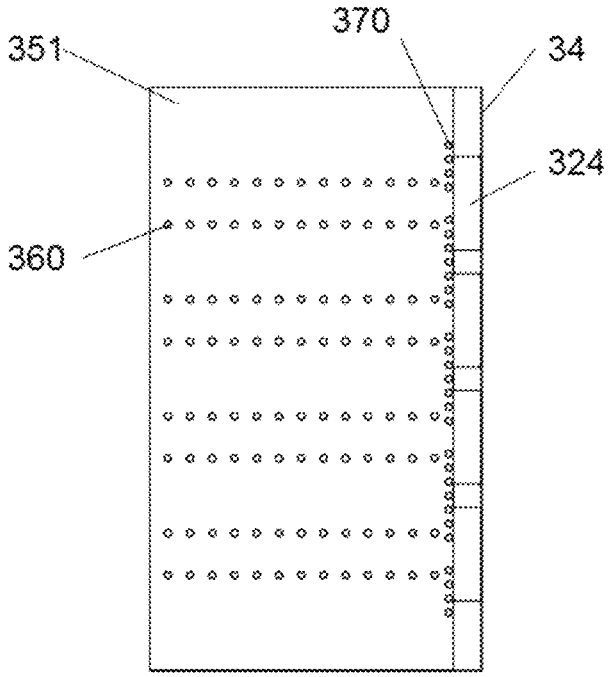
FIG. 13 is a plan view of the fourth printed copper layer of a four-element antenna array according to another embodiment of the present invention.
Figure 14:
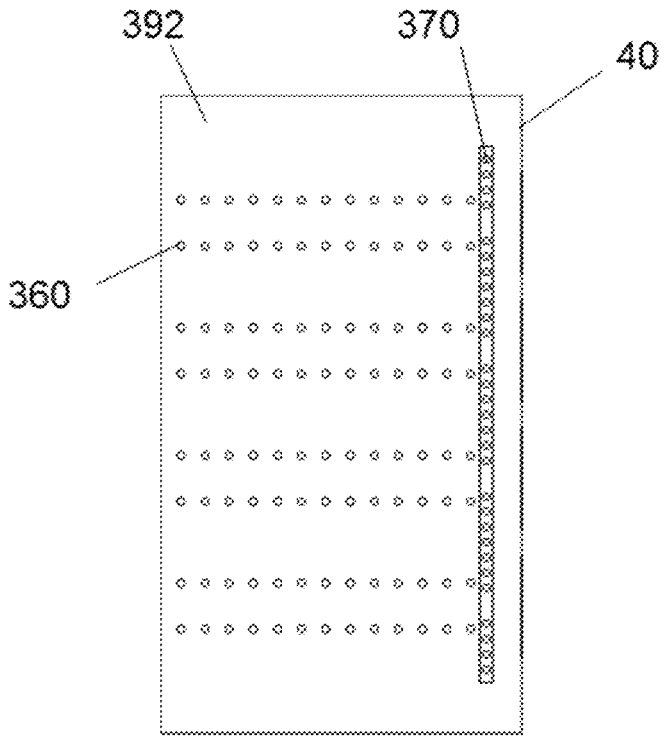
FIG. 14 is a plan view of the fifth printed copper layer of a four-element antenna array according to another embodiment of the present invention.

The difference between this embodiment and embodiment 1 is that they have different structures of antenna elements. FIG. 9 illustrates the stereogram of a four-element antenna array. FIG. 10 shows the first printed copper layer printed on the upside surface of the substrate 39. FIG. 11 shows the second printed copper layer printed between the substrate 39 and the substrate 33. FIG. 12 shows the third printed copper layer printed between the substrate 33 and the substrate 34. FIG. 13 shows the fourth printed copper layer printed between the substrate 34 and the substrate 40. FIG. 14 shows the fifth printed copper layer printed on the underside surface of the substrate 40.

This structure differs from the one shown in FIG. 5. The first rectangular metal block 310 and the second rectangular metal block 314 in FIG. 5 are replaced by the first printed copper layer 380 and the second printed copper layer 384. The first printed copper layer 380 is printed on the thickness direction of the third PCB dielectric substrate 39 by using the metal wrapping process, and the second printed copper layer 384 is printed on the thickness direction of the fourth PCB dielectric substrate 40 by using the metal wrapping process. The first printed copper layer 380 printed on the third PCB dielectric substrate 39 is perpendicular to the first rectangular printed copper layer 320 printed near the edge of the first PCB dielectric substrate 33.

The second printed copper layer 384 on the fourth PCB dielectric substrate 40 is perpendicular to the second rectangular printed copper layer 324 printed near the edge of the second PCB dielectric substrate 34. The first group of metal vias 360 and the second group of metal vias 370 are connected with the first PCB dielectric substrate 33, the second PCB dielectric substrate 34, the third PCB dielectric substrate 39 and the fourth PCB dielectric substrate 40. The third printed copper layer 391 is printed on the upside surface of the third PCB dielectric substrate 39. The fourth printed copper layer 392 is printed on the underside surface of the fourth PCB dielectric substrate 40. The first group of metal vias 360 or the second group of metal vias 370 are connected with the first printed copper layer 350, the second printed copper layer 351, the third printed copper layer 391 and the fourth printed copper layer 392. The printed copper layers that form electrical dipole antenna elements of the present invention are printed on the thickness direction of the third PCB dielectric substrate 39 and the fourth PCB dielectric substrate 40, and then it can reduce the size of the electric dipole to about quarter-wavelength in the substrate 39 and 40, thus a relatively low profile antenna array is obtained.

Embodiment 3

Figure 15:
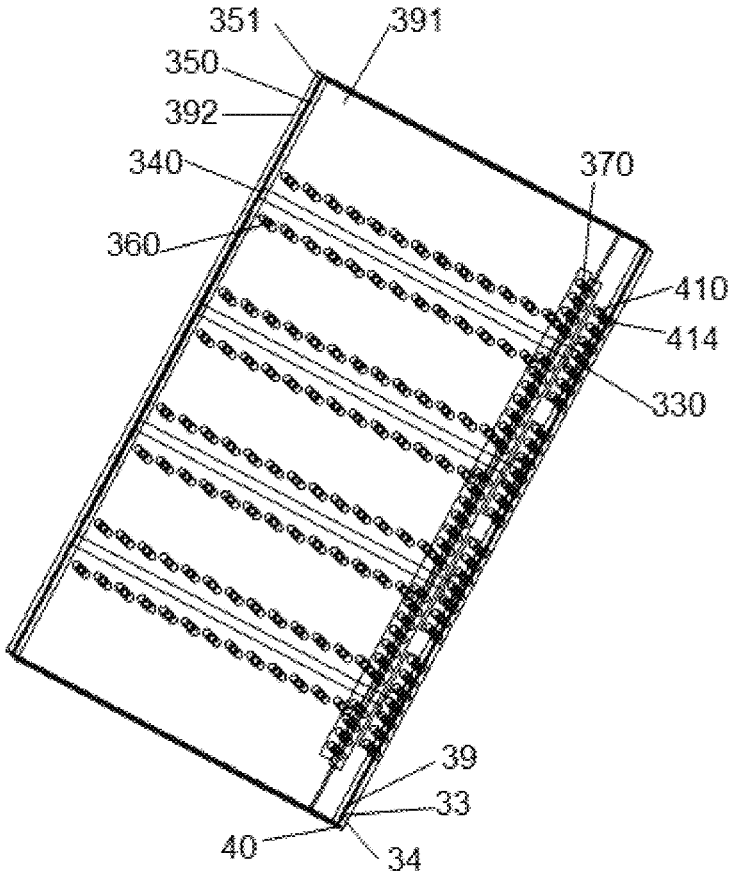
FIG. 15 is the stereogram of a four-element antenna array according to another embodiment of the present invention.
Figure 16:
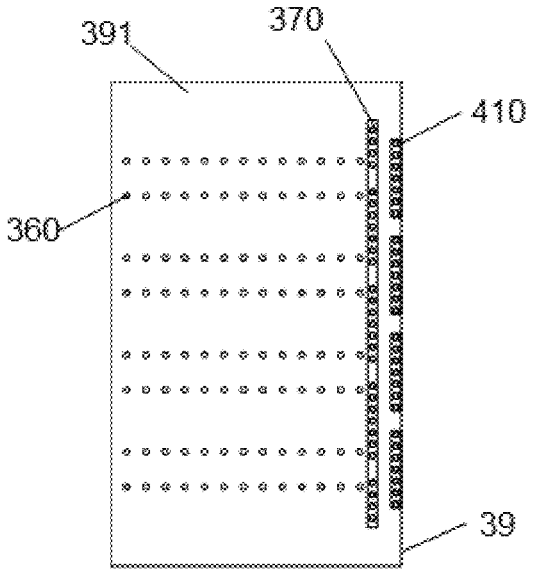
FIG. 16 is a plan view of the first printed copper layer of a four-element antenna array according to another embodiment of the present invention.
Figure 17:
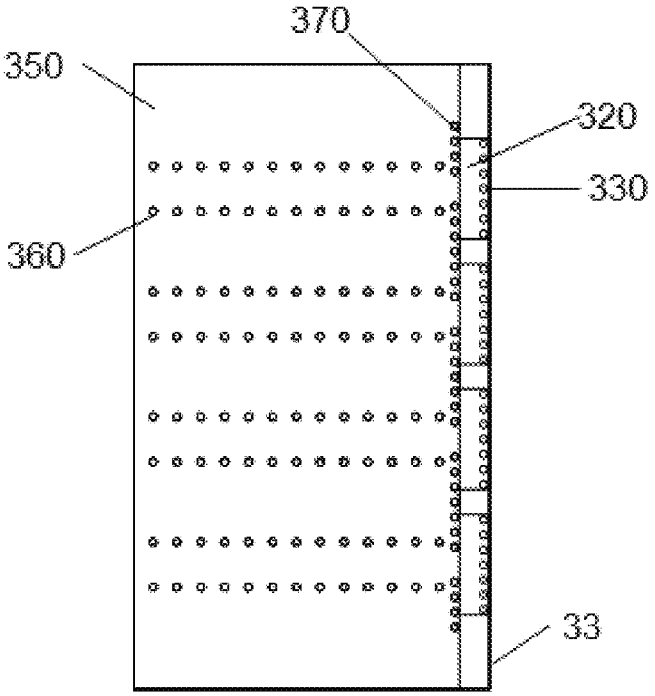
FIG. 17 is a plan view of the second printed copper layer of a four-element antenna array according to another embodiment of the present invention.
Figure 18:
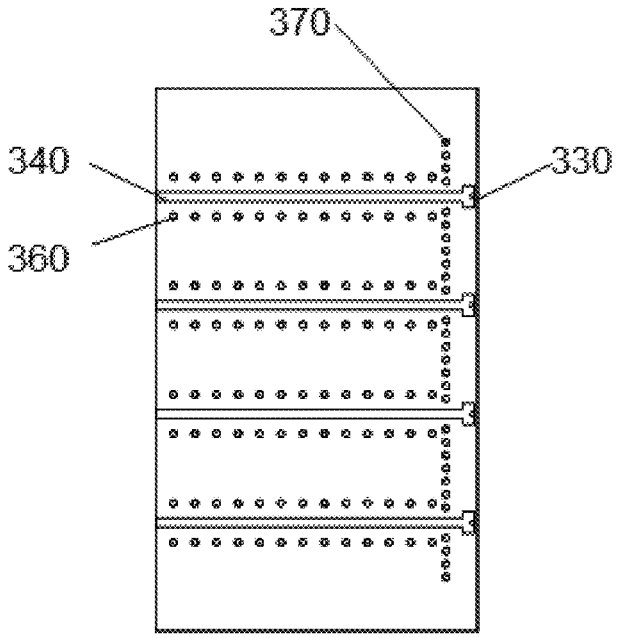
FIG. 18 is a plan view of the third printed copper layer of a four-element antenna array according to another embodiment of the present invention.
Figure 19:
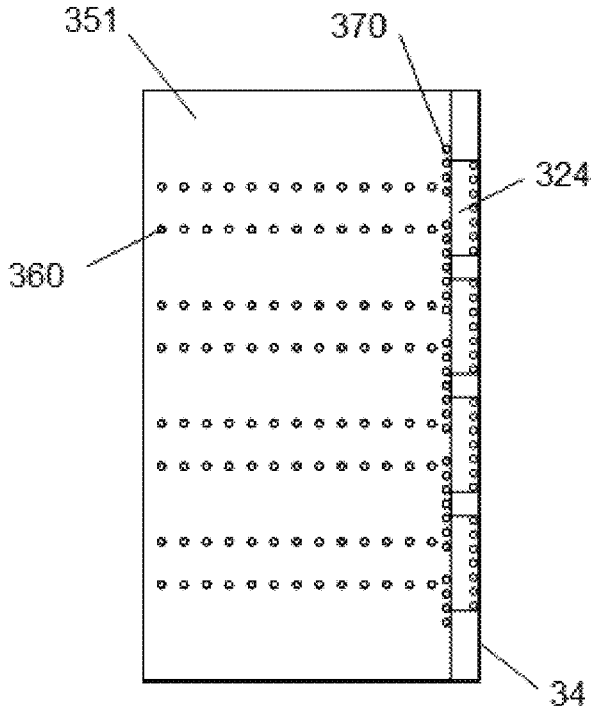
FIG. 19 is a plan view of the fourth printed copper layer of a four-element antenna array according to another embodiment of the present invention.
Figure 20:
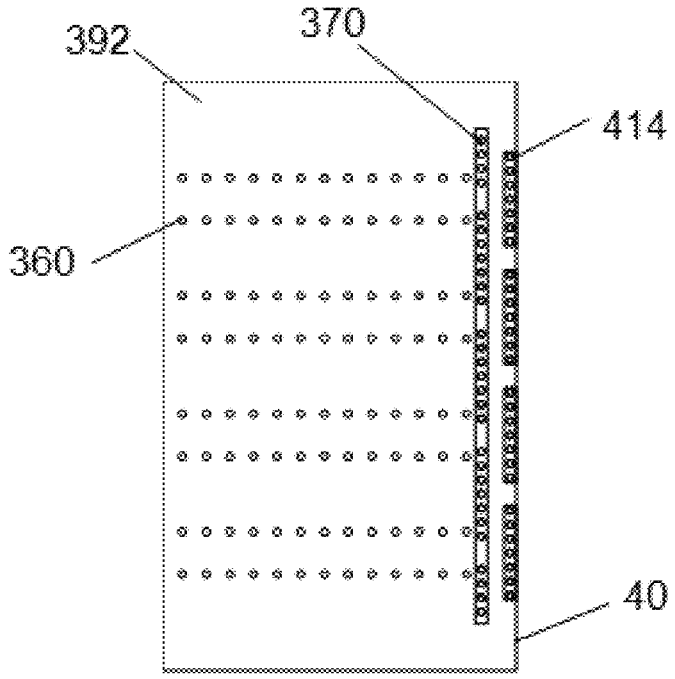
FIG. 20 is a plan view of the fifth printed copper layer of a four-element antenna array according to another embodiment of the present invention.

The difference between this embodiment and embodiment 2 is that they have different structures of antenna elements. FIG. 15 illustrates the stereogram of a four-element antenna array. FIG. 16 shows the first printed copper layer printed on the upside surface of the substrate 39. FIG. 17 shows the second printed copper layer printed between the substrate 39 and the substrate 33. FIG. 18 shows the third printed copper layer printed between the substrate 33 and the substrate 34. FIG. 19 shows the fourth printed copper layer printed between the substrate 34 and the substrate 40. FIG. 20 shows the fifth printed copper layer printed on the underside surface of the substrate 40.

This structure differs from the one shown in FIG. 9. The first printed copper layer 380 and the second printed copper layer 384 are replaced by the third group of metal vias 410 and the fourth group of metal vias 414. The third group of metal vias 410 passes through the third PCB dielectric substrate 39, and the fourth group of metal vias 414 passes through the fourth PCB dielectric substrate 40, and the third group of metal vias 410 in the third PCB dielectric substrate 39 is perpendicular to the first rectangular printed copper layer 320 printed near the edge of the first PCB dielectric substrate 33, and the fourth group of metal vias 414 in the fourth PCB dielectric substrate 40 is perpendicular to the second rectangular printed copper layer 324 printed near the edge of the second PCB dielectric substrate 34, and the first group of metal vias 360 and the second group of metal vias 370 are connected with the first PCB dielectric substrate 33, the second PCB dielectric substrate 34, the third PCB dielectric substrate 39 and the fourth PCB dielectric substrate 40.

The third printed copper layer 391 is printed on the upside surface of the third PCB dielectric substrate 39. The fourth printed copper layer 392 is printed on the underside surface of the fourth PCB dielectric substrate 40. The first group of metal vias 360 or the second group of metal vias 370 are connected with the first printed copper layer 350, the second printed copper layer 351, the third printed copper layer 391 and the fourth printed copper layer 392. The two groups of metal vias that form electrical dipole antenna elements of the present invention have almost the same performance with the antenna array in the embodiment 2. However, because the metal vias are embedded in the substrate, the antenna array structure in embodiment 3 is more stable.

Figure 21:
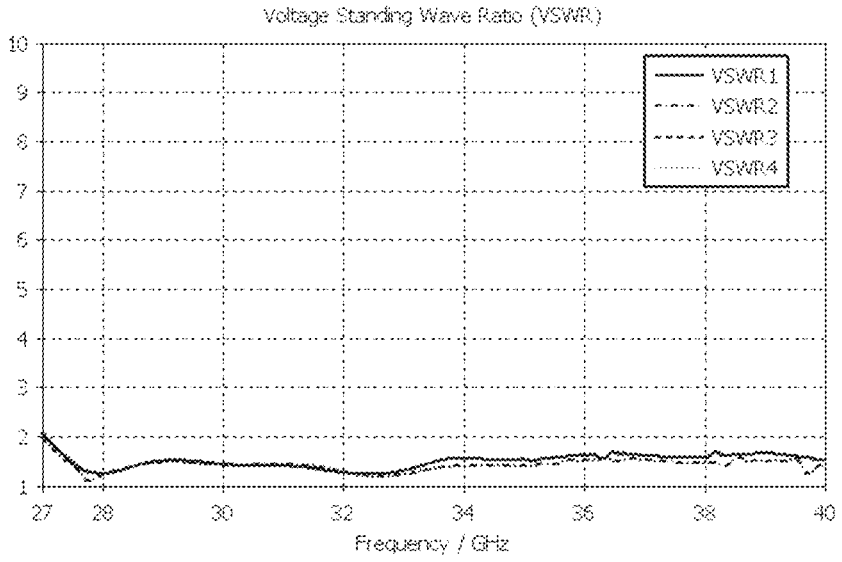
FIG. 21 is curves of standing wave ratio of each ports of a four-element antenna array according to one embodiment of the present invention.
Figure 22:
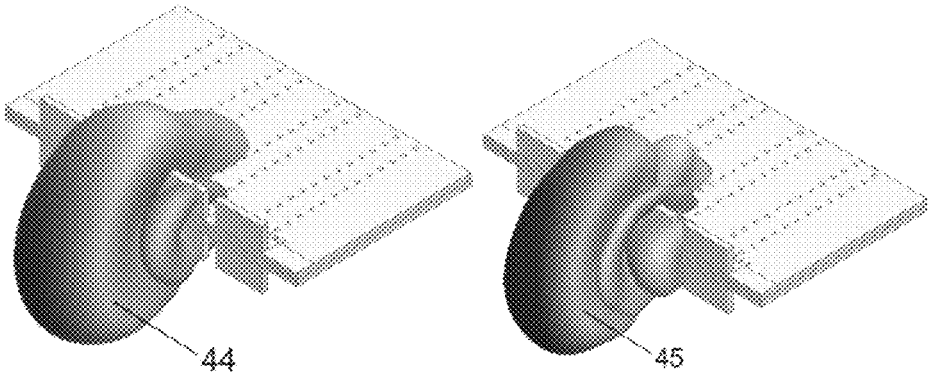
FIG. 22 is the radiation pattern of the four-element antenna array when the signal phases of the four ports are the same.
Figure 23:
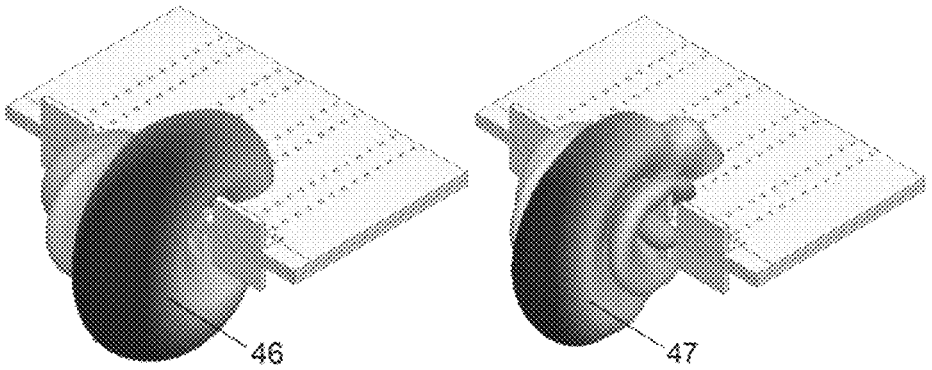
FIG. 23 is the radiation pattern of the four-element antenna array when the signal phases difference between adjacent ports is 45 degree.
Figure 24:
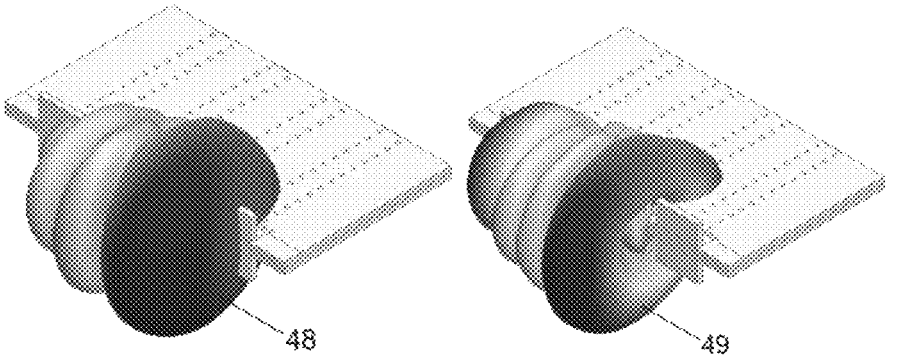
FIG. 24 is the radiation pattern of the four-element antenna array when the signal phases difference between adjacent ports is 135 degree.

FIGS. 21 to 24 illustrate simulation results of the antenna array shown in FIG. 5 according to the first embodiment of the present invention. In particular, a four-element antenna array that can cover 27 GHz to 40 GHz bands is chosen. FIG. 21 shows the VSWR curves of the four-element antenna array. The value of VSWR in each port is below 2 in the frequency range from 27 GHz to 40 GHz. FIG. 22 shows the radiation pattern of the four-element antenna array when the signal phases of the four ports are the same. Graph 44 in FIG. 22 is the radiation pattern of the antenna array at 28 GHz, and graph 45 in FIG. 22 is the radiation pattern of the antenna array at 39 GHz. FIG. 23 shows the radiation pattern of the four-element antenna array when the signal phases difference between adjacent ports is 45 degree, graph 46 in FIG. 23 is the radiation pattern of the antenna array at 28 GHz, and graph 47 in FIG. 23 is the radiation pattern of the antenna array at 39 GHz. FIG. 24 shows the radiation pattern of the four-element antenna array when the signal phases difference between adjacent ports is 135 degree. Graph 48 in FIG. 24 is the radiation pattern of the antenna array at 28 GHz, and graph 49 in FIG. 24 is the radiation pattern of the antenna array at 39 GHz.

Figure 25:
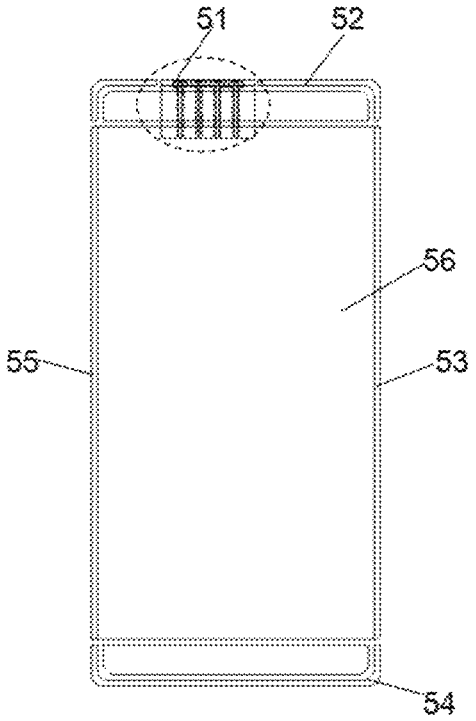
FIG. 25 is a stereogram of an antenna array integrated on a mobile terminal back cover according to one embodiment of the present invention.
Figure 26:
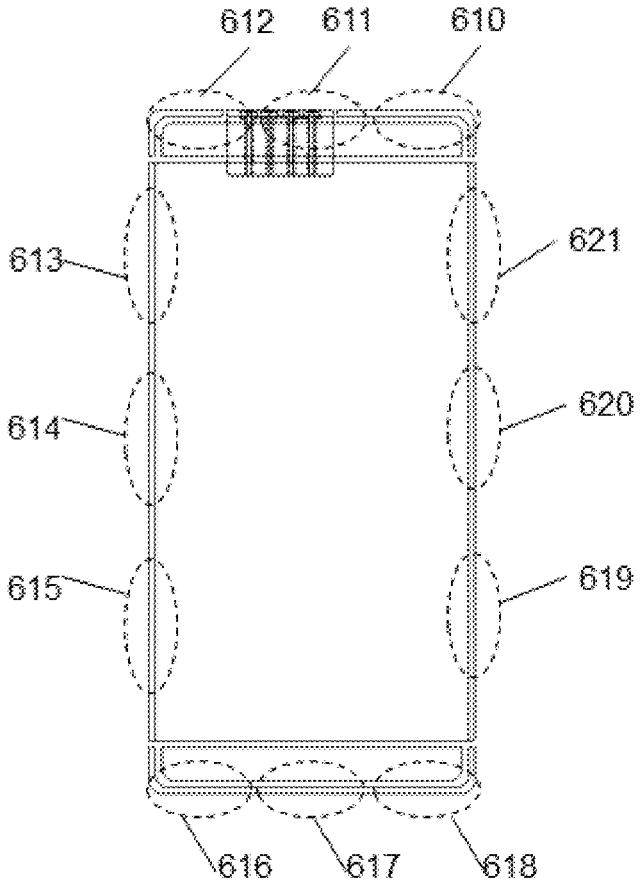
FIG. 26 is the placement of the four-element antenna array in the mobile terminal according to one embodiment of the present invention.

FIG. 25 is the stereogram of an antenna array integrated on the mobile terminal back cover according to the first embodiment of the present invention. The mobile terminal may be a smartphone or a portable device. The material of the back cover and the frame of the mobile terminal can be metal or nonmetal. When the frame of the mobile terminal is nonmetal, the position of the antenna array may be arbitrarily arranged along the frame. When the frame of the mobile terminal is metal, gaps need to be cut out on the border to ensure good performance of the antenna array. FIG. 25 illustrates the placement of an antenna array using a mobile terminal with metal frame as an example. As shown in FIG. 25, the mobile terminal is composed of a back cover 56 and an up-side frame 52, a right-side frame 53, a left-side frame 55, and a down-side frame 54. FIG. 26 shows the placement of the four-element antenna array in the mobile terminal according to the first embodiment of the present invention. The position of the four-element antenna array can be in the position 610,611,612 of the up-side frame of the mobile terminal, or in the position 616,617,618 of the down-side frame, or in the position 613,614,615 of the left-side frame, or in the position 619,620,621 of the right-side frame.

Figure 27:
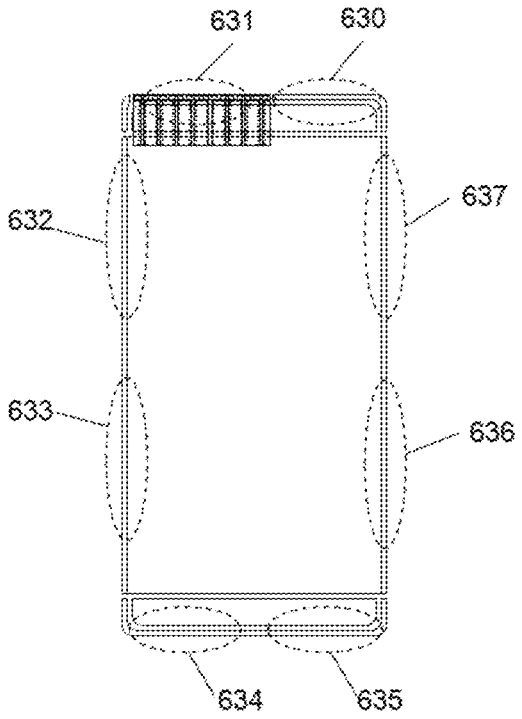
FIG. 27 is the placement of the eight-element antenna array in the mobile terminal according to one embodiment of the present invention.
Figure 28:
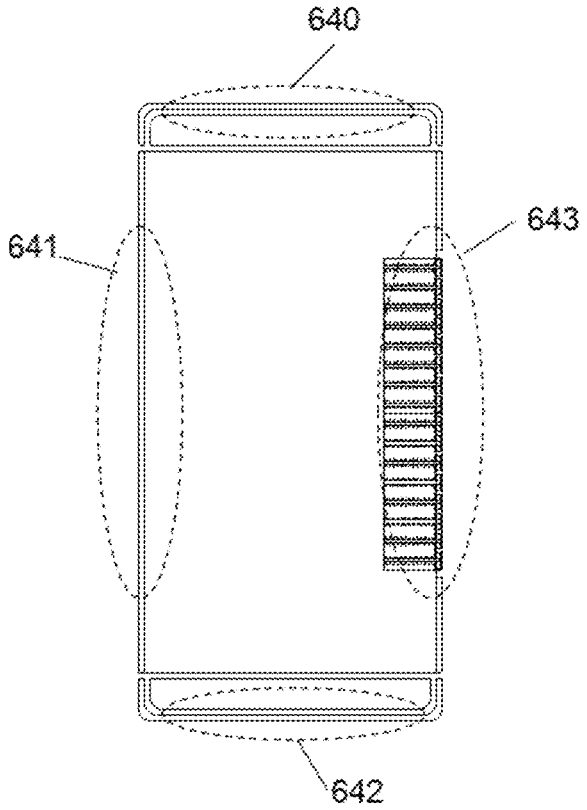
FIG. 28 is the placement of the sixteen-element antenna array in the mobile terminal according to one embodiment of the present invention.

Since the embodiment of the present invention is not limited to a four-element antenna array, FIG. 27 and FIG. 28 illustrate an example of an eight-element antenna array and a sixteen-element antenna array respectively. FIG. 27 shows the placement of the eight-element antenna array in the mobile terminal according to the first embodiment of the present invention. The eight-element antenna array of the present invention can be placed in the position 630, 631 of the up-side frame, or in the position 634,635 of the down-side frame, or in the position 632, 633 of the left-side frame, or in the position 636,637 of the right-side frame. FIG. 28 shows the placement of the sixteen-element antenna array in the mobile terminal according to the first embodiment of the present invention. The sixteen-element antenna array of the present invention can be placed in the position 640 of the up-side frame, or in the position 642 of the down-side frame, or in the position 641 of the left-side frame, or in the position 643 of the right-side frame. The advantages of the present invention are that the position of the antenna array can be flexibly selected and the antenna array can coexist with the traditional mobile communication antennas such as 3G, 4G, GPS and Wi-Fi antennas. The occupied clearance area of the antenna array is small, and end-fire radiation pattern is easily obtained.

Figure 29:
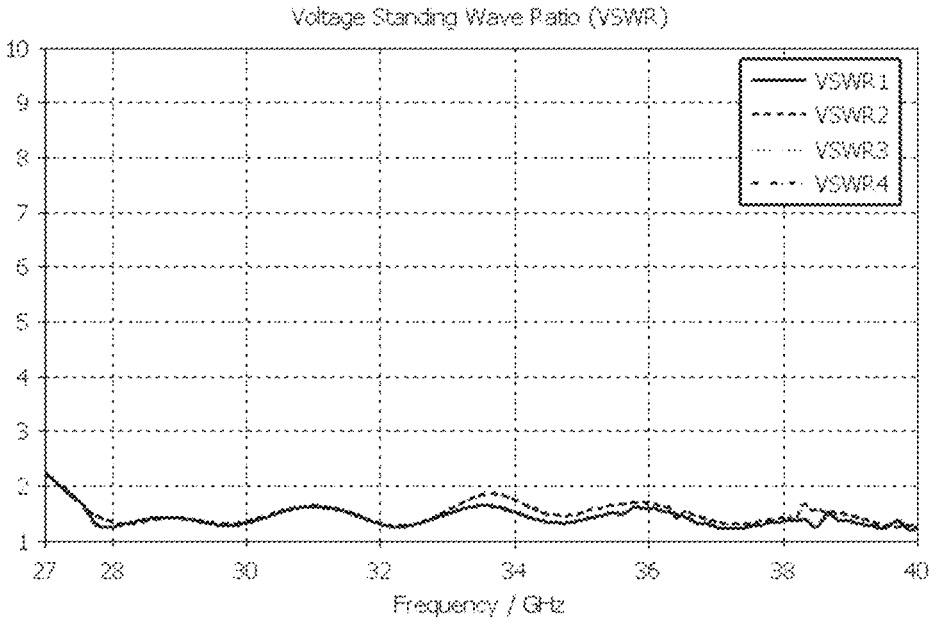
FIG. 29 is simulated standing wave ratio curves of four ports when the four-element antenna array are integrated on the mobile terminal according to one embodiment.
Figure 30:
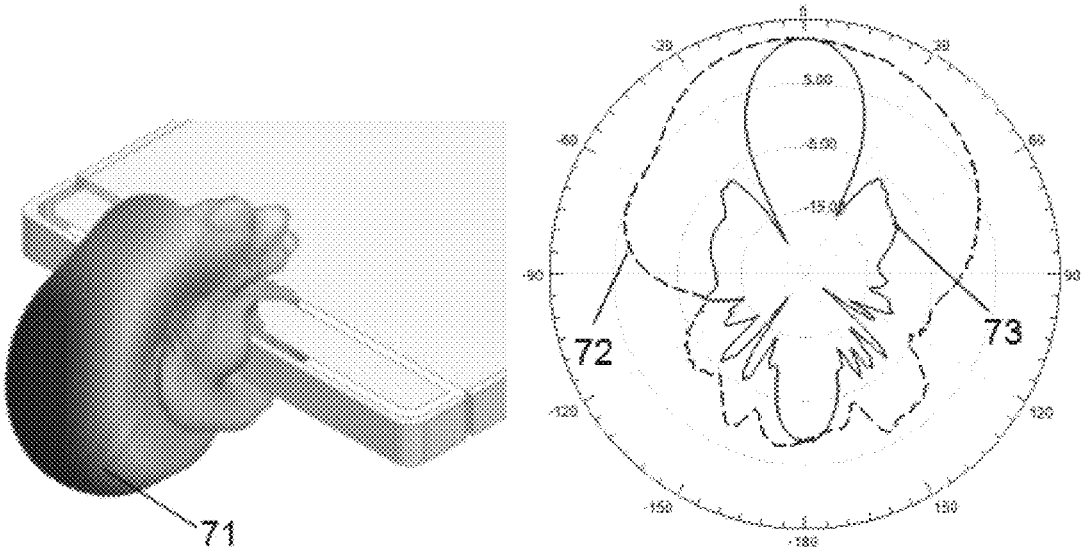
FIG. 30 is the simulated radiation pattern of the four-element antenna array when four ports are fed in phase according to one embodiment of the present invention.
Figure 31:
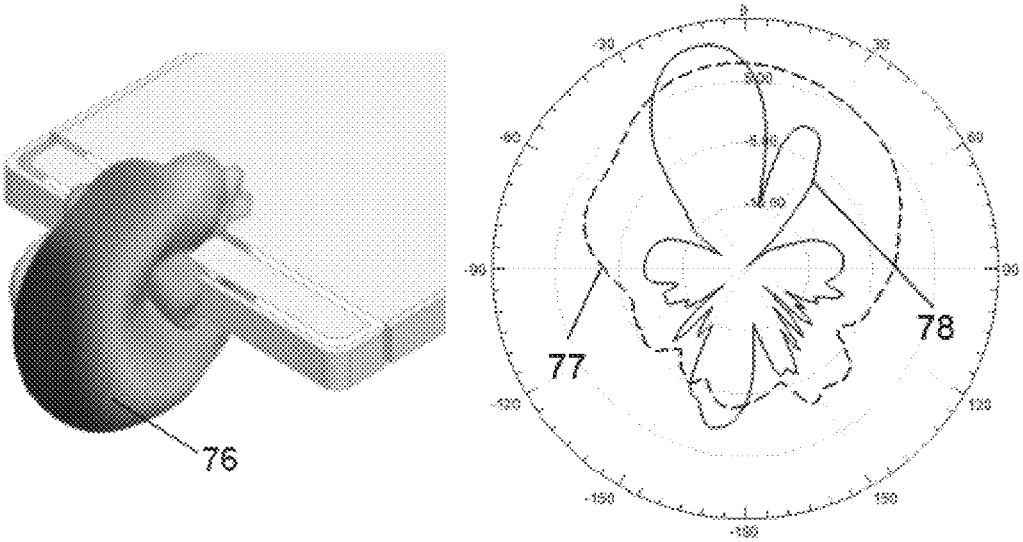
FIG. 31 is the simulated radiation pattern of the four-element antenna array when four ports are fed in a phase difference of 45 degree according to one embodiment of the present invention.

FIGS. 29 to 31 illustrate simulation results of the antenna array shown in FIG. 26 according to the first embodiment of the present invention. FIG. 29 shows the VSWR curves of the four-element antenna array integrated in a mobile terminal. The value of VSWR in each port is below 2 in the frequency range from 27 GHz to 40 GHz. FIG. 30 shows the simulated radiation pattern of the four-element antenna array when four ports are fed in the same phase in the embodiment 1 of the present invention. Graph 71 in FIG. 30 is the 3D radiation pattern of the antenna array, and graph 72 in FIG. 30 is the radiation pattern of the cut plane when theta=90 degree, and graph 73 in FIG. 30 is the radiation pattern of the cut plane when theta=0. FIG. 31 shows the simulated radiation pattern of the four-element antenna array when four ports are fed in a phase difference of 45 degree in the embodiment 1 of the present invention, and graph 76 in FIG. 31 is the 3D radiation pattern of the antenna array, and graph 77 in FIG. 31 is the radiation pattern of the cut plane when theta=90 degree, and graph 78 in FIG. 31 is the radiation pattern of the cut plane when theta=0.

Obviously, the above embodiments of the present invention are merely for the purpose of clearly stating examples of the invention rather than the limitation of the embodiments of the present invention. As for those skilled in the art in the field, there may be other variations or variations on the basis of the foregoing instructions. There is no need to be exhaustive of all implementations. Any modifications, equivalents, substitutions and improvements made within the spirit and principles of the present invention shall be included in the scope of protection of the claims of the present invention.

What is claimed is:

1. An antenna array apparatus for a 5G mobile terminal, comprising:

a plurality of magneto-electric dipole antenna elements, wherein each magneto-electric dipole antenna element comprises an electric dipole and a magnetic dipole, wherein the electric dipole and the magnetic dipole are perpendicularly intersected, and wherein a midpoint of the intersection is a feed point, wherein the electric dipole comprises a first rectangular metal block and a second rectangular metal block, wherein the magnetic dipole comprises a first rectangular copper layer and a second rectangular copper layer, the first rectangular metal block being connected to the first rectangular copper layer through surface mounting technology (SMT), the second rectangular metal block being connected to the second rectangular copper layer through surface mounting technology (SMT); and a radio frequency (RF) frontend module, wherein the plurality of magneto-electric dipole antenna elements are connected to the RF frontend module respectively.

2. An antenna array apparatus of claim 1, wherein magneto-electric dipole antenna elements are of the same or a similar structure, wherein a space between the magneto-electric dipole antenna elements is determined according to an antenna array radiation pattern or an antenna array scanning angle.

3. The antenna array apparatus of claim 2, wherein a space between each of the magneto-electric dipole antenna elements is ranging from a half-wavelength to one wavelength.

4. The antenna array apparatus of claim 1, wherein each of the magneto-electric dipole antenna elements is excited by a multi-band or a broadband RF frontend module, and wherein the RF frontend module is connected to a feeder line of the magneto-electric dipole antenna elements.

5. The antenna array apparatus of claim 4, wherein the RF frontend module is connected to the magneto-electric dipole antenna elements by the surface mounting technology (SMT).

6. The antenna array apparatus of claim 1, wherein a bandwidth of the RF frontend module covers a plurality of millimeter-wavebands, and wherein beam forming and beam scanning of the antenna array apparatus are performed by controlling a phase difference of the magneto-electric dipole antenna elements connected to the RF frontend module.

7. The antenna array apparatus of claim 1, wherein the antenna array apparatus is located at a top, a bottom, a left, or a right side of a handheld mobile terminal.

8. The antenna array apparatus of claim 1, wherein the RF frontend module comprises:

a switch;

a receiving module;

a transmitting module; and a local oscillation signal generating module for generating four quadrature local oscillation signals supplied to the transmitting module and the receiving module, wherein the receiving module and the transmitting module are respectively connected with the switch, and wherein the switch is connected with the magneto-electric dipole antenna elements.

9. The antenna array apparatus of claim 1, wherein the electric dipole can be a metal block, wrapped copper, or metal vias along a thickness direction of a printed circuit board (PCB), wherein the magnetic dipole comprises a pair of copper layers on an upper side and a lower side of the PCB and a group of metal vias, and wherein the PCB is formed by laminating different layers of a dielectric substrate.

* * * * *